US007128626B2

(12) United States Patent
Dudra et al.

(10) Patent No.: US 7,128,626 B2
(45) Date of Patent: Oct. 31, 2006

(54) MARINE STEERING ASSEMBLY WITH CONNECTING MEMBER

(75) Inventors: Brian Dudra, Vancouver (CA); Leon Keng, Vancouver (CA)

(73) Assignee: Teleflex Canada Incorporated, Richmond (CA)

( * ) Notice: Subject to any disclaimer, the term of this patent is extended or adjusted under 35 U.S.C. 154(b) by 0 days.

(21) Appl. No.: 11/033,112

(22) Filed: Jan. 12, 2005

(65) Prior Publication Data

US 2006/0154535 A1 Jul. 13, 2006

(51) Int. Cl.
*B63H 5/125* (2006.01)

(52) U.S. Cl. ..... 440/63; 440/61 S

(58) Field of Classification Search ..... 440/63, 440/61 S

See application file for complete search history.

(56) References Cited

U.S. PATENT DOCUMENTS 4,573,930 A 3/1986 Queen
4,778,418 A * 10/1988 Mondek ..... 440/63
4,836,812 A * 6/1989 Griffiths ..... 440/61 R
5,092,801 A 3/1992 McBeth et al.
5,643,022 A 7/1997 Wagner
5,997,370 A 12/1999 Fetchko et al.
6,406,340 B1 6/2002 Fetchko et al.
6,913,497 B1 * 7/2005 Ahlswede et al. ..... 440/63

* cited by examiner

*Primary Examiner*—Stephen Avila
(74) *Attorney, Agent, or Firm*—Norman M. Cameron

(57) ABSTRACT

There is provided a hydraulic steering assembly for applying a force to two or more marine propulsion units. Each propulsion unit has a steering axis and a tilt axis. The tilt axis is generally perpendicular to the steering axis thereof. Each propulsion unit is rotatable about the steering axis and is supported for arcuate movement about the tilt axis thereof. The steering assembly comprises a hydraulic steering actuator including a cylinder and an elongated piston rod. The cylinder has a first end and a second end. The elongated piston rod is reciprocatingly mounted within the cylinder and extends through the cylinder for movement along a piston rod axis. A pair of support arms are pivotable about the tilt axis of a first propulsion unit. The support arms are connected to the piston rod axis allowing arcuate movement of the piston rod about the tilt axis, while maintaining the piston rod axis parallel to the tilt axis. A pivot member is pivotally mounted on the first said propulsion unit for pivoting about a first link axis, which is parallel to the steering axis. The actuator is pivotally connected to the pivot member for pivoting about a second link axis, which is parallel to the piston rod axis. A connecting member is connected to the actuator. The connecting member includes a portion for connecting the connecting member to the actuator and a portion for pivotally connecting an elongated member to the connecting member.

9 Claims, 3 Drawing Sheets

MARINE STEERING ASSEMBLY WITH CONNECTING MEMBER

BACKGROUND OF INVENTION

This invention relates to steering assemblies for simultaneously steering two or more marine propulsion units, and in particular, to a connecting member for coupling the propulsion units together, allowing for simultaneous steering.

Hydraulic steering systems have been developed for marine propulsion units. Such steering systems conventionally include a steering wheel with an associated hydraulic pump and hydraulic lines connecting the pump to a steering assembly. The steering assembly is mounted on a propulsion unit. In some earlier systems, the steering assembly includes a pivot plate or pivot member which is pivotally connected to the tiller of an outboard motor or other propulsion unit. A pair of support arms or support brackets extend outwardly from the tilt tube of the motor. The piston rod of a hydraulic actuator is mounted on the support arms. The actuator has connecting members extending outwardly from the cylinder thereof which are pivotally connected to the pivot member for pivoting about an axis parallel to the piston rod.

When there are two or more propulsion units, a tie-bar typically connects the steering assembly to the second propulsion unit. Conventionally, the tie-bar is connected to the tillers or to plates attached to the tillers. More recently, as disclosed in U.S. Pat. No. 6,406,340 to Fetchko et al., the tie-bar has been connected to a member attached to the pivot plate, allowing for rotation of the steering assembly about a steering axis and arcuate movement of the steering assembly about a tilt axis that is generally perpendicular to the steering axis.

SUMMARY OF INVENTION

According to one aspect of the invention, there is provided a hydraulic steering assembly for applying a force to two or more marine propulsion units. Each propulsion unit has a steering axis and a tilt axis, the tilt axis being generally perpendicular to the steering axis thereof. Each propulsion unit is rotatable about the steering axis thereof and is supported for arcuate movement about the tilt axis thereof. The steering assembly comprises a hydraulic steering actuator, including a cylinder and an elongated piston rod. The cylinder has a first end and a second end. The elongated piston rod is reciprocatingly mounted within the cylinder and extends through the cylinder for movement along a piston rod axis.

A pair of support arms are pivotable about the tilt axis of a first said propulsion unit. The support arms are connected to the piston rod, allowing arcuate movement of the piston rod about the tilt axis while maintaining the piston rod axis parallel to the tilt axis. A pivot member is pivotally mounted on the first said propulsion unit for pivoting about a first link axis, which is generally parallel to the steering axis. The actuator is pivotally connected to the pivot member for pivoting about a second link axis, which is generally parallel to the piston rod axis. A connecting member is connected to the actuator. An elongated member is pivotally connected to the connecting member and the elongated member is connected to a second said propulsion unit.

The elongated member may be pivotally connected to the connecting member by a ball joint. The connecting member may be connected to the actuator, however, the connecting member may also be formed in one piece with the actuator.

The connecting member may also be connected to the pivot member, the pivot member preferably being a pivot plate. The assembly may have the connecting member connected to the first end of the cylinder and another connecting member connected to the second end of the cylinder, the connecting members may be pivotally connected to the pivot plate for pivoting about the second link axis.

According to another aspect of the invention, there is provided a connecting member for a hydraulic steering actuator. The actuator includes a cylinder and an elongated piston rod reciprocatingly mounted within the cylinder. The piston rod extends through the cylinder for movement along a piston rod axis. The actuator steers two or more marine propulsion units. Each said propulsion unit is rotatable about a steering axis and about a tilt axis which is generally perpendicular to the steering axis thereof.

The connecting member comprises a means for connecting the connecting member to the actuator and a means for pivotally connecting an elongated member to the connecting member. The elongated member may also be connected to a second marine propulsion unit, allowing for simultaneous steering of the first said propulsion unit and the second said propulsion unit.

The means for connecting the connecting member to the actuator may include a first cylindrical projection. The connecting member may be connected to the actuator by inserting the first cylindrical projection into the cylinder. The means for pivotally connecting the connecting member to the elongated member may include a clevis. The elongated member may be connected to the connecting member at the clevis by a ball joint.

Preferably, the connecting member includes a first potion and second portion. The first portion may have a first side and a second side, the first side being opposite to the second side. The second portion may also have a first side and a second side, the first side being opposite to the second side. An aperture may extend from the first side of the first portion through to the second side of the first portion. A clevis may be on the first side of the second portion. A first cylindrical projection may be on the second side of the first portion. The first cylindrical projection may be circumambient to the aperture. A second cylindrical projection may be on the first side of the second portion.

According to a further aspect of the invention, there is provided a hydraulic steering assembly for applying a force to two or more marine propulsion units. Each propulsion unit has a steering axis and a tilt axis, the tilt axis being generally perpendicular to the steering axis thereof. Each propulsion unit is rotatable about the steering axis thereof and is supported for arcuate movement about the tilt axis thereof. The method comprises connecting an elongated member to a hydraulic steering actuator of a first said propulsion unit and connecting the elongated member to a second said propulsion unit.

The elongated member may be pivotally connected to the actuator. A steering force for the second said propulsion unit may be transferred from the actuator along the elongated member to the second said propulsion unit. The elongated member may be pivotally connected to the second said propulsion unit.

In a typical prior art unit the elongated member is bolted to the pivot plate. This results in large offset forces. By attaching the elongated member directly to the actuator the load point is more aligned with the rotational axis and offset forces which may stress the steering assembly are reduced. This results in a steering assembly that is safer and more robust.

The invention offers a further advantage over to the prior art by reducing the number of bolted connections, consequently reducing cost and assembly time.

DETAILED DESCRIPTIONS OF THE PREFERRED EMBODIMENTS

Figure 1:
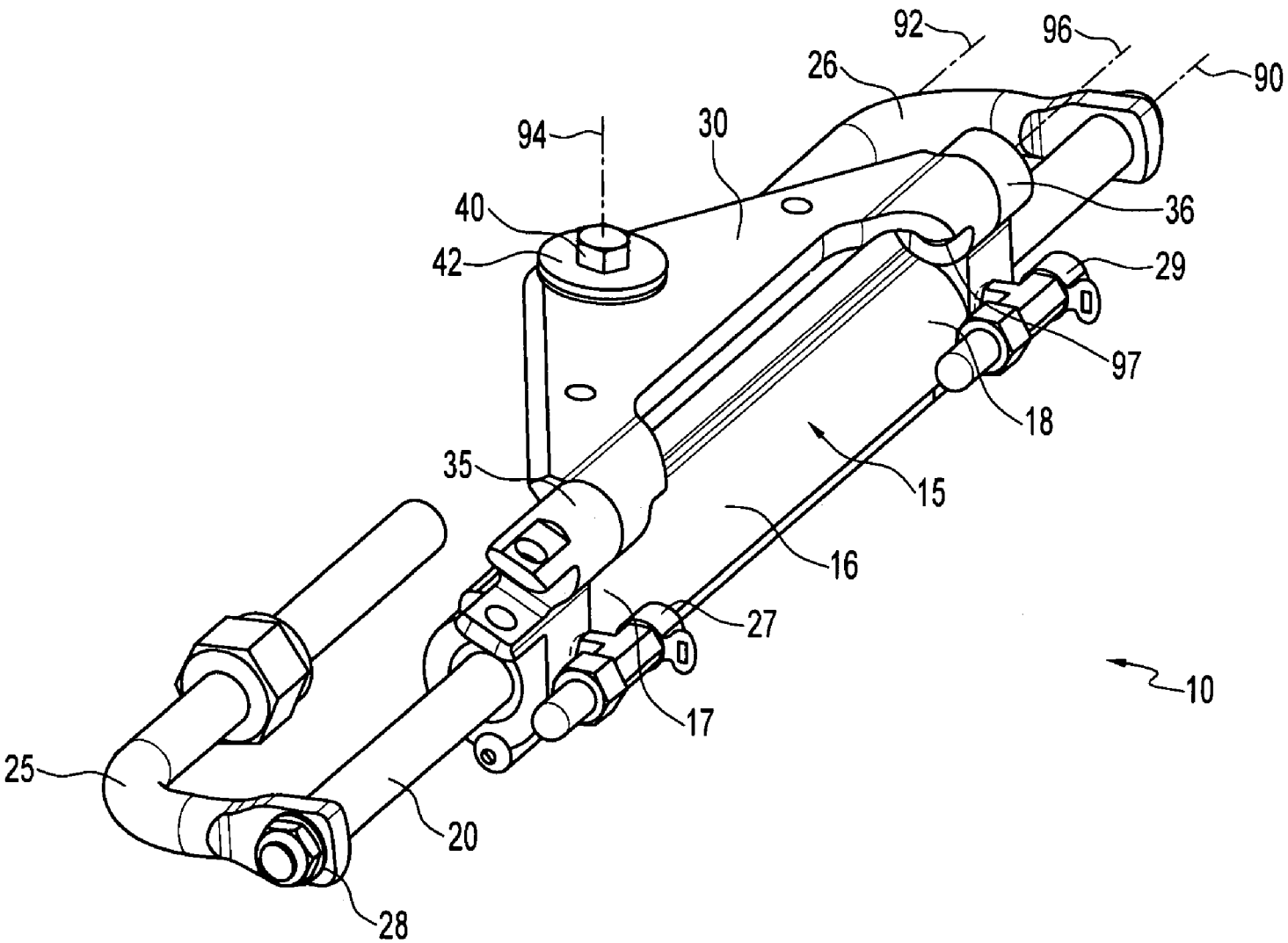
FIG. 1 is a top, rear isometric view of a hydraulic steering assembly according to an embodiment of the invention.

Referring to the drawings, and first to FIG. 1, this shows a hydraulic steering assembly 10. The steering assembly includes an actuator 15 which includes a cylinder 16, a piston rod 20 and end portions 35 and 36 which form ends of the actuator in this embodiment. One of the end portions in this example, namely end portion 35, comprises a connecting member, having an integral clevis 56, shown in FIG. 2, as described in more detail below, for connecting to member 65 shown in FIG. 3. The cylinder 16 has a first end 17 and a second end 18. The piston rod 20 is reciprocatingly mounted within the cylinder 16, extending through the cylinder and the end portions 35 and 36, allowing for movement of the piston rod along a piston rod axis 90. There is a pair of support arms 25 and 26 which are pivotable about a tilt axis 92. Each arm has an aperture 28, shown for arm 25, which connects each arm 25 and 26 to one end of the piston rod 20, allowing for arcuate movement of the piston rod about the tilt axis 92 while maintaining the piston rod parallel to the tilt axis. Hydraulic fittings 27 and 29 are connected to the actuator 15 at the opposite ends thereof for supplying hydraulic fluid to move the piston (not shown) and accordingly the piston rod 20.

There is a pivot member, in this case a pivot plate 30. The pivot plate 30 is pivotally mounted on a propulsion unit 31, shown in fragment in FIG. 3, by a joint formed by a bolt 40, a washer 42 and a nut (not shown), permitting the pivot plate to pivot about a first link axis 94, which is parallel to a steering axis 95. The propulsion unit 31 could be an outboard motor or an inboard/outboard motor. The actuator 15 is pivotally connected to the pivot plate 30 by the end portions 35 and 36 which allow pivoting of the actuator about a second link axis 96 which is parallel to the piston rod axis 90. The end portions 35 and 36 are connected to the first end 17 and second end 18 respectfully of the cylinder 16.

Figure 2:
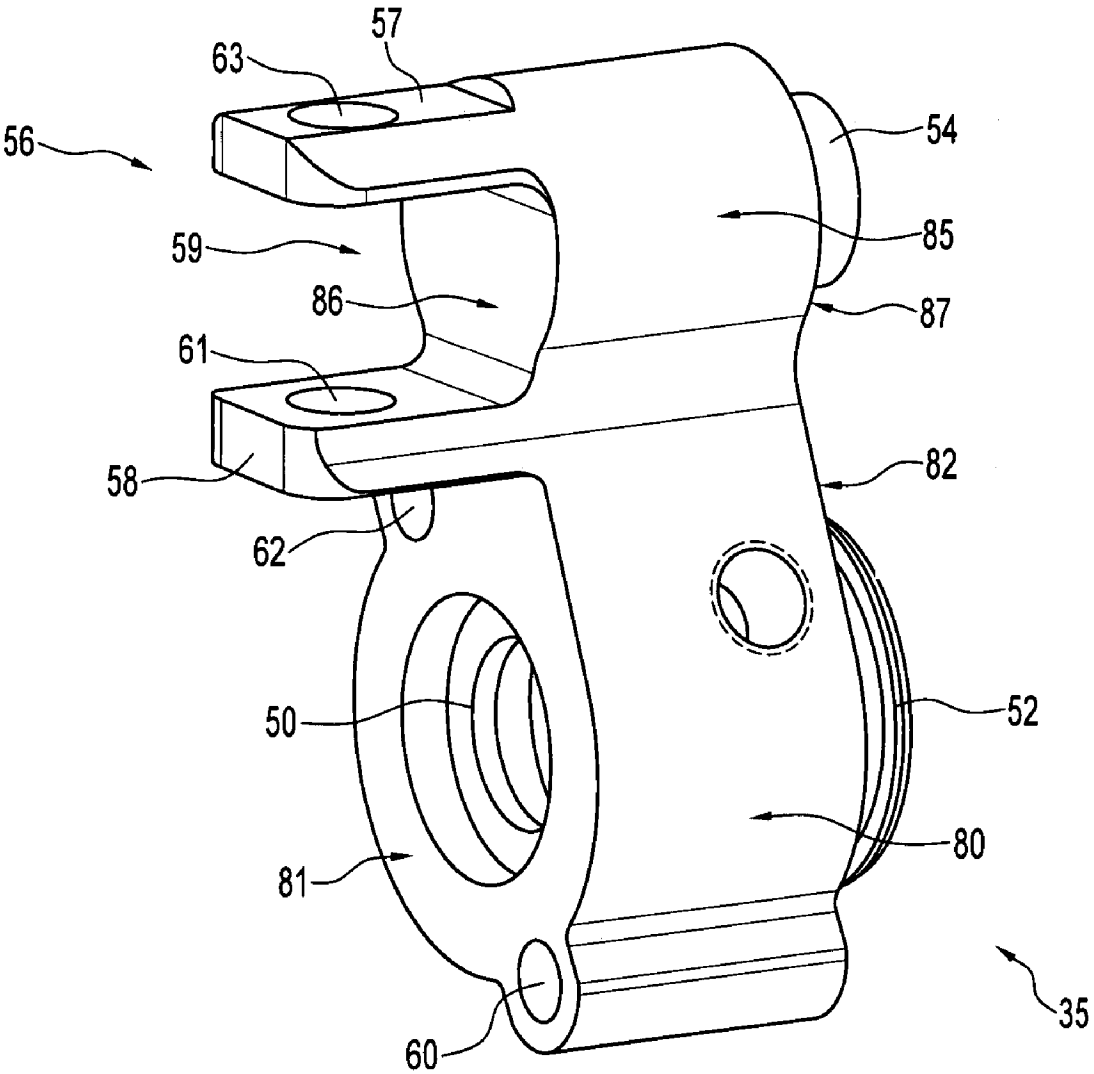
FIG. 2 is an isometric view of one of the connecting members thereof.

End portion 35 is shown in better detail in FIG. 2. End portion 36 is similar to end portion 35 except end portion 36 does not have a clevis 56 as shown for end portion 35. The end portions 35 and 36 each have a first portion 80 and a second portion 85. The first portion 80 has a first side 81 and a second side 82, the first side being opposite to the second side. The second portion 85 also has a first side 86 and second side 87, the first side being opposite to the second side.

The end portions 35 and 36 each also have an aperture 50, which is co-axially aligned with the piston rod axis. The piston rod 20 extends slidably through the aperture 50. There is a first cylindrical projection 52 that is circumambient to the aperture 50. The first cylindrical projection 52 is received within the cylinder 16, connecting the end portion to the cylinder 16. Bolts (not shown) extend through apertures 60 and 62 and corresponding threaded apertures in the cylinder 16.

The end portions 35 and 36 each further have a second cylindrical projection 54 which is co-axially aligned with the second link axis 96 when the end portions are installed. The second cylindrical projection of each of the end portions is rotatably received within a complementary recess 97 of the pivot plate 30, as shown in FIG. 1. Accordingly, the second cylindrical projections 54 and complementary cylindrical recesses serve to pivotally connect the end portions 35 and 36 to the pivot plate, allowing for pivoting of the actuator 15 about the second link axis 96 which is parallel to the piston rod axis 90.

Figure 3:
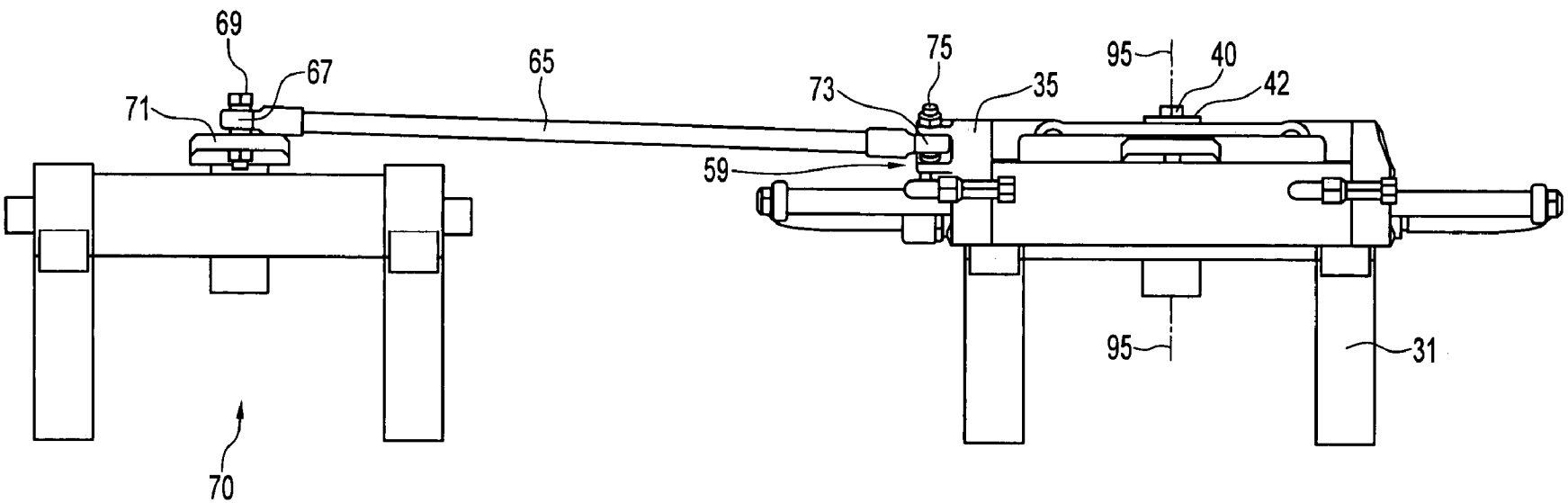
FIG. 3 is an elevational view showing a hydraulic steering assembly according to an embodiment of the invention and a fragment of a second propulsion unit with the pivotal connections therebetween.

End portion 35, as shown best in FIG. 2, serves as a connecting member and has a clevis 56. As mentioned above, end portion 36 in this example lacks the clevis. Although end portion 36 could have a clevis, it would be unused in the illustrated example. The clevis includes a pair of projections 57 and 58 with a space 59 therebetween. Apertures 61 and 63 extend through the projections 57 and 58. An elongated member 65, a tie-rod in this example, is connected at one end to the end portion 35 by an articulated connection, in this case a ball joint 73. The elongated member 65 is received in the space 59 of the clevis 56, as shown in FIG. 3. A bolt 75 extends through the apertures 61 and 63 and the ball joint. The opposite end of the elongated member is pivotally connected to a second propulsion unit 70, in this case by a bolt 69 and ball joint 67 connected to the tiller thereof.

In this embodiment the elongated member 65 is connected to end portion 35 at one end of the actuator 15. However, it could be pivotally connected to the actuator 15 by a connecting member or some other pivotal connection elsewhere on the cylinder. For example the connection could be between the ends of the cylinder.

It will be understood by someone skilled in the art that many of the details provided above are given by way of example only and can be altered or deleted without departing from the scope of the invention as set out in the following claims.

What is claimed is:

1. A hydraulic steering assembly for applying a force to two marine propulsion units, each said propulsion unit having a steering axis and a tilt axis, the tilt axis being generally perpendicular to the steering axis thereof, said each propulsion unit being rotatable about the steering axis thereof and being supported for arcuate movement about the tilt axis thereof, the steering assembly comprising:

a hydraulic steering actuator, the actuator including a cylinder and an elongated piston rod reciprocatingly mounted within the cylinder, the piston rod extending through the cylinder for movement along a piston rod axis, the cylinder having a first end and a second;

a pair of support arms which are pivotable about the tilt axis of a first said propulsion unit, the support arms being connected to the piston rod, allowing arcuate movement of the piston rod about the tilt axis of the first said propulsion unit and maintaining the piston rod axis generally parallel to the tilt axis thereof;

a pivot member pivotally mounted on the first said propulsion unit for pivoting about a first link axis which is generally parallel to the steering axis of the first said propulsion unit, the actuator being pivotally connected to the pivot member for pivoting about a second link axis which is generally parallel to the piston rod axis;

a connecting member connected to the actuator, at one said end of the cylinder; and an elongated member pivotally connected to the connecting member and to a second said propulsion unit;

wherein the elongated member is pivotally connected to the connecting member.

2. A hydraulic steering assembly for applying a force to two marine propulsion units, each said propulsion unit having a steering axis and a tilt axis, the tilt axis being generally perpendicular to the steering axis thereof, said each propulsion unit being rotatable about the steering axis thereof and being supported for arcuate movement about the tilt axis thereof, the steering assembly comprising:

a hydraulic steering actuator, the actuator including a cylinder and an elongated piston rod reciprocatingly mounted within the cylinder, the piston rod extending through the cylinder for movement along a piston rod axis, the cylinder having a first end and a second end;

a pair of support arms which are pivotable about the tilt axis of a first said propulsion unit, the support arms being connected to the piston rod, allowing arcuate movement of the piston rod about the tilt axis of the first said propulsion unit and maintaining the piston rod axis generally parallel to the tilt axis thereof, a pivot member pivotally mounted on the first said propulsion unit for pivoting about a first link axis which is generally parallel to the steering axis of the first said propulsion unit, the actuator being pivotally connected to the pivot member for pivoting about a second link axis which is generally parallel to the piston rod axis;

a connecting member connected to the actuator; and an elongated member pivotally connected to the connecting member and to a second said propulsion unit;

wherein the actuator is formed in one piece with the connecting member.

3. A hydraulic steering assembly for applying a force to two marine propulsion units, each said propulsion unit having a steering axis and a tilt axis, the tilt axis being generally perpendicular to the steering axis thereof, said each propulsion unit being rotatable about the steering axis thereof and being supported for arcuate movement about the tilt axis thereof, the steering assembly comprising:

a hydraulic steering actuator, the actuator including a cylinder and an elongated piston rod reciprocatingly mounted within the cylinder, the piston rod extending through the cylinder for movement along a piston rod axis, the cylinder having a first end and a second end;

a pair of support arms which are pivotable about the tilt axis of a first said propulsion unit the support arms being connected to the piston rod, allowing arcuate movement of the piston rod about the tilt axis of the first said propulsion unit and maintaining the piston rod axis generally parallel to the tilt axis thereof;

a pivot member pivotally mounted on the first said propulsion unit for pivoting about a first link axis which is generally parallel to the steering axis of the first said propulsion unit, the actuator being pivotally connected to the pivot member for pivoting about a second link axis which is generally parallel to the piston rod axis;

a connecting member connected to the actuator; and an elongated member pivotally connected to the connecting member and to a second said propulsion unit;

wherein the pivot member is a pivot plate, the assembly having the connecting member connected to the first end of the cylinder and another connecting member connected to the second end of the cylinder, the connecting members being pivotally connected to the pivot plate for pivoting about the second link axis.

4. A connecting member for a hydraulic steering actuator, the actuator including a cylinder and an elongated piston rod reciprocatingly mounted within the cylinder, the piston rod extending through the cylinder for movement along a piston rod axis, the actuator being for steering two marine propulsion units, the actuator being connected to a first said propulsion unit, each said propulsion unit having a steering axis and a tilt axis, the tilt axis being generally perpendicular to the steering axis thereof, said each propulsion unit being rotatable about the steering axis thereof and being supported for arcuate movement about the tilt axis thereof, the connecting member comprising:

means for connecting the connecting member to the actuator; and means for pivotally connecting an elongated member to the connecting member, whereby the elongated member can also be connected to a second said marine propulsion unit, allowing simultaneous steering of the first said propulsion unit and the second said propulsion unit;

wherein the means for connecting the connecting member to the actuator includes a first cylindrical projection.

5. The connecting member as claimed in claim 4, wherein the connecting member is connected to the actuator by inserting the first cylindrical projection into the cylinder.

6. A connecting member for a hydraulic steering actuator, the actuator including a cylinder and an elongated piston rod reciprocatingly mounted within the cylinder, the piston rod extending through the cylinder for movement along a piston rod axis, the actuator being for steering two marine propulsion units, the actuator being connected to a first said propulsion unit, each said propulsion unit having a steering axis and a tilt axis, the tilt axis being generally perpendicular to the steering axis thereof, said each propulsion unit being rotatable about the steering axis thereof and being supported for arcuate movement about the tilt axis thereof, the connecting member comprising:

a first portion, the first portion having a first side and a second side, the first side being opposite to the second side;

a second portion, the second portion having a first side and a second side, the first side being opposite to the second side;

an aperture extending from the first side of the first portion to the second side of the first portion for slidably receiving the piston rod;

a clevis for receiving the elongated member, the clevis being on the first side of the second portion;

a first cylindrical projection for connecting member into one end of the cylinder, the first cylindrical projection being on the second side of the first portion, the first cylindrical projection being circumambient to the aperture; and a second cylindrical projection for pivotally connecting the cylinder for pivoting about an axis parallel to the piston rod axis, the second cylindrical being on the second side of the second portion;

wherein the connecting member can be connected to the actuator and the connecting member can be pivotally connected to an elongate member, whereby the elongated member can also be connected to a second said marine propulsion unit, thereby allowing simultaneous steering of the first said propulsion unit and the second said propulsion unit.

7. The hydraulic assembly as claimed in claim 1, wherein the connecting member has an aperture, the piston rod extending slidably through said aperture.

8. The hydraulic assembly as claimed in claim 7, wherein the connecting member has a cylindrical projection received in one said end of the cylinder.

9. The hydraulic assembly as claimed in claim 1, wherein the connecting member includes a clevis, the elongated member being pivotally connected to the clevis.

* * * * *

UNITED STATES PATENT AND TRADEMARK OFFICE

CERTIFICATE OF CORRECTION

PATENT NO. : 7,128,626 B2
APPLICATION NO. : 11/033112
DATED : October 31, 2006
INVENTOR(S) : Brian Dudra and Leon Keng It is certified that error appears in the above-identified patent and that said Letters Patent is hereby corrected as shown below:

Col. 4-5, claim 1, should read as follows:
1. A hydraulic steering assembly for applying a force to two marine propulsion units, each said propulsion unit having a steering axis and a tilt axis, the tilt axis being generally perpendicular to the steering axis thereof, said each propulsion unit being rotatable about the steering axis thereof and being supported for arcuate movement about the tilt axis thereof, the steering assembly comprising: a hydraulic steering actuator, the actuator including a cylinder end an elongated piston rod reciprocatingly mounted within the cylinder, the piston rod extending through the cylinder for movement along a piston rod axis, the cylinder having a first end and a second end; a pair of support arms which are pivotable about the tilt axis of a first said propulsion unit, the support arms being connected to the piston rod, allowing arcuate movement of the piston rod about the tilt axis of the first said propulsion unit and maintaining the piston rod axis generally parallel to the tilt axis thereof; a pivot member pivotally mounted on the first said propulsion unit for pivoting about a first link axis which is generally parallel to the steering axis of the first said propulsion unit, the actuator being pivotally connected to the pivot member for pivoting about a second link axis which is generally parallel to the piston rod axis; a connecting member connected to the actuator, at one said end of the cylinder; and an elongated member pivotally connected to the connecting member and to a second said propulsion unit.

Col. 6-7, claim 6, should read as follows:
6. A connecting member for a hydraulic steering actuator, the actuator including a cylinder and an elongated piston rod reciprocatingly mounted within the cylinder, the piston rod extending through the cylinder for movement along a piston rod axis, the actuator being for steering two marine propulsion units, the actuator being connected to a first said propulsion unit, each said propulsion unit having a steering axis and a tilt axis, the tilt axis being generally perpendicular to the steering axis thereof, said each propulsion unit being rotatable about the steering axis thereof and being supported for arcuate movement about the tilt axis thereof, the connecting member comprising: a first portion, the first portion having a first side and a second side, the first side being opposite to the second side; a second portion, the second portion having a first side and a second side, the first side being opposite to the second side; an aperture extending from the first side of the first portion to the second side of the first Signed and Sealed this
Tenth Day of April, 2012

David J. Kappos

David J. Kappos
*Director of the United States Patent and Trademark Office* portion for slidably receiving the piston rod; a clevis for receiving the elongated member, the clevis being on the first side of the second portion; a first cylindrical projection for connecting the member into one end of the cylinder, the first cylindrical projection being on the second side of the first portion, the first cylindrical projection being circumambient to the aperture; and a second cylindrical projection for pivotally connecting the cylinder for pivoting about an axis parallel to the piston rod axis, the second cylindrical projection being on the second side of the second portion; wherein the connecting member can be connected to the actuator and the connecting member can be pivotally connected to an elongate member, whereby the elongated member can also be connected to a second said marine propulsion unit, thereby allowing simultaneous steering of the first said propulsion unit and the second said propulsion unit.